United States Patent [19]

Fairbrother

[11] 4,362,224

[45] Dec. 7, 1982

[54] DISCRETE POSITION LOCATION SENSOR

[75] Inventor: Robert E. Fairbrother, Simsbury, Conn.

[73] Assignee: Otis Elevator Company, Farmington, Conn.

[21] Appl. No.: 304,212

[22] Filed: Sep. 21, 1981

Related U.S. Application Data

[63] Continuation of Ser. No. 93,475, Nov. 13, 1977, abandoned.

[51] Int. Cl.[3] ..... B66B 3/02

[52] U.S. Cl. ..... 187/29 R; 340/21

[58] Field of Search ..... 187/29; 250/237 R, 237 G, 250/561, 578; 318/480, 640; 340/19 R, 21, 686

[56] References Cited

U.S. PATENT DOCUMENTS 3,815,711 6/1974 Hoelscher ..... 187/29

3,963,098 6/1976 Lewis et al. ..... 187/29

*Primary Examiner*—J. V. Truhe

*Assistant Examiner*—W. E. Duncanson, Jr.

*Attorney, Agent, or Firm*—M. P. Williams

[57] ABSTRACT

A discrete position encoder includes a plurality of detectors, arranged along a direction of motion or relative position between two objects, which are rendered responsive in either of two states by another member which is relatively movable with respect thereto, such as light beams established by light sources and optical detectors being interruptible by a vane. The vane is adjusted so that when the two objects are centrally aligned with each other, the two outermost detectors have a state opposite to other detectors. Two rows of detectors are provided to permit flexibility in designing the positional extent of detectable discrete positions. Exemplary decoding includes the decoding of as many fault states as acceptable decodable discrete position states. Embodiments with opposite detector states (ON/OFF vs OFF/ON) are disclosed.

5 Claims, 6 Drawing Figures

DISCRETE POSITION LOCATION SENSOR

This is a continuation of application Ser. No. 093,475 filed on Nov. 13, 1977 now abandoned.

DESCRIPTION

1. Technical Field

This invention relates to position transducers, and more particularly to non-contact, discrete location sensors; although not necessarily limited thereto, the invention has significant suitability for use in applications where the position of one object is desired to be known with respect to a plurality of different points, and/or where the detectable discrete positions are symmetrical with respect to central alignment, such as an elevator car with respect to a plurality of floor landings.

2. Background Art

A discrete optical position sensor useful in detecting the position of an elevator car with respect to a floor landing is disclosed in U.S. Pat. No. 3,749,203. Therein, the elevator car has mounted to it a plurality of light sources and light detectors in a C-shaped configuration, the light source/detector pairs being arranged vertically. A plurality of light-interrupting vanes, one for each floor landing, are each mounted at a corresponding position with respect to the floor landing, directly to the wall of the hoistway. As the elevator traverses the hoistway near the landing, the vane mounted on the hoistway wall interrupts one, more or all of the light beams, indicating progression toward and location at the floor landing. In that position detector, the dead zone (perfectly centered position) is represented by having all the lights off, and is therefore not capable of meaningful self-health error or fault detection.

In a commonly owned copending U.S. patent application Ser. No. 970,783, filed on Dec. 18, 1978 by Marvin Masel and entitled FLOOR DISTANCE SENSOR FOR AN ELEVATOR CAR, a similar arrangement of a plurality of vertically-disposed light beams mounted by a C-shaped member to an elevator car also interacts with a plurality of hoistway-mounted opaque vanes. In said application, change from one discrete positional zone to the next is derived by taking into account transitions between the on and off states of the several detectors. The ON/OFF states decode to non-useful, unsymmetrical positional zones, and the transitions between states identify the zone boundaries in a symmetrical way. But, the device of the aforementioned application is dependent upon the transitions to identify pairs of possible zone transfers, which occur in a nonsymmetrical or discontinuous fashion, due to the irregular spacing of the optical beams, and resolves these by a complex code combination of ON/OFF states as well as transitions.

Further, each of the devices described above uses more optical paths (source and detector), than is required for the number of states detected, even when bidirectionality requirements are considered. Therefore, neither of the aforementioned devices are capable of reliable self-health error detection.

Aspects of discrete position transducers to be used for landing zone identification in elevator systems, for instance, include the need for symmetry about the centrally-aligned position in either direction of motion, maintenance of tolerance at the zone transfer points at any speed (slow, fast, crawl in either direction), or stopped, and reliability to a level satisfiable only by every-unit fault detection capability.

DISCLOSURE OF INVENTION

Objects of the invention include provision of a discrete position encoder in which any single mode failure will cause a decodable valid position indication to instead be decoded as an error indication and provision of a discrete position encoder in which variations in the positional extent of decodable discrete ranges of position are separately adjustable.

According to the invention, the relative position of first and second relatively movable members is determined by interaction of one of the members with a plurality of detectors on the other of the members, the two members being relatively configured so that when said two members are centrally aligned, the outermost detectors have a state which is opposite to at least some other detectors.

According further to the invention, a discrete position encoder of the type in which the relative position of two relatively movable members is determined by interaction between one of the members and a plurality of detectors on the other member is provided with flexibility in establishing a plurality of discretely detectable relative positions, the positional extent of differences in the detectable positions being independently adjustable with respect to others of said positions.

The present invention provides a highly versatile and reliable discrete position sensor, particularly where positional zones are to be detected, as in elevator systems. The invention provides relatively simple single fault detection and the possibility for double fault detection, by having discrete encoded positions as well as impermissible codes which are discretely encoded into faults. The invention has the capability of being implemented in a manner in which none of the permissible discretely decodable positions include all of the detectors being in a most likely fail-mode state (e.g. binary zeros or off). This permits reliable self-health in that each valid position which is decodable includes at least one detector in the ON, or most failure prone state. The invention is implementable with a minimum number of detectors per desired decoded discrete position, with, at the same time, a maximum number of fault-indicating decodable states, whereby the maximum amount of self-health is provided while using a minimum number of detectors per discrete position to be encoded. The invention is easily implemented to provide bidirectional, symmetrical positional zone decoding.

Although the invention is readily adapted for implementation using light sources and photo detectors, it is also easily adapted for implementation by other phenomena, such as reluctance sensors, and so forth. The invention is well suited to detecting the position of an elevator car with respect to a plurality of discrete floors, the active detectors being mounted on the elevator car, and light-occluding vanes being mounted along the shaftway with respect to each floor landing to which the car is to be accurately positioned. However, the invention may also be used in a variety of other applications, either comparing the position of one object (such as a car) with the plurality of positions (such as discrete floor landings) or with respect to plural objects and plural positions.

The foregoing and various other objects, features and advantages will become more apparent in the light of the following detailed description of exemplary embodiments thereof, as illustrated in the accompanying drawing.

BEST MODE FOR CARRYING OUT THE INVENTION

Figure 1:
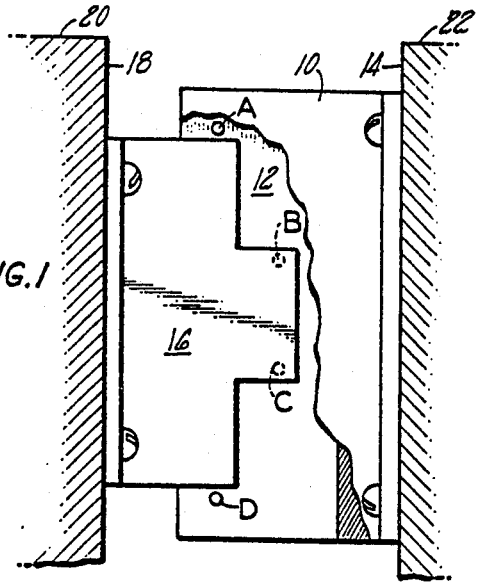
FIG. 1 is a side elevation view, partially broken away, of a first embodiment of the present invention.
Figure 2:
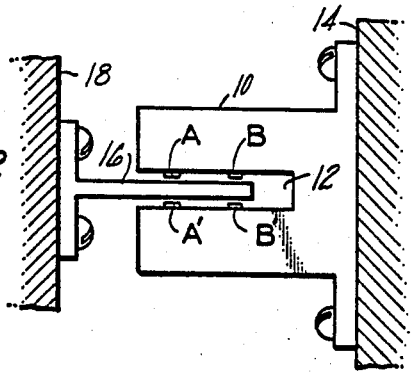
FIG. 2 is a top plan view of the embodiment of the invention illustrated in FIG. 1.

Referring now to FIGS. 1 and 2, a first embodiment of the invention comprises a generally C-shaped optical member 10 having a plurality of optical sensors A–D disposed thereon at one side of a slot 12 therein, with corresponding optical sources A′, B′ mutually aligned on the opposite side of the slot 12 from the related sensors A, B. The optical unit 10 is fixed to a member 14, such as an elevator when the invention is used in a hoistway, or any other member with which the present invention is to be utilized.

A vane 16 (shown in a stepped configuration in FIG. 1) is disposed on a fixed member 18, such as the wall of a hoistway in an elevator system, when the invention is used to determine the position of an elevator with respect to a plurality of floors; in such case, a plurality of vanes 16 would normally be provided since they are relatively inexpensive, only one optical unit 10 being provided on the elevator car, each vane 16 being suitably disposed with respect to the landing of each floor in the hoistway, the optical unit 10 being disposed with respect to the floor 22 of the elevator (as illustrated in FIG. 1) so that the relative positioning of the optical unit 10 and the vane 16 is an indication of the position of the elevator with respect to the landing floor 20. The optical sensors A–D are exemplary of one form of non-contacting detector with which the invention may be used. In such case, the vane 16 is opaque, and simply serves to block the passage of light between the sources A′, B′ and the sensors A, B as seen in FIG. 2. On the other hand, the sensors A–D may comprise other types of detectors, such as magnetic reluctance detectors, in which case the detectors need be disposed only on one side of the slot 12, and the vane 16 need comprise magnetic material so as to alter the reluctance of the detectors when in the proximity thereof, although these may have directional nonsymmetry and low gain at low speed. Similarly, other detection mechanisms may be used employing different types of phenomenon.

Figure 3:
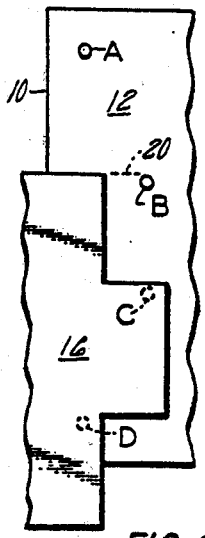
FIG. 3 is a partial side elevation view of the embodiment illustrated in FIG. 1, at a particular position.

In the embodiment shown in FIGS. 1 and 2, the position of the vane with respect to the detector is determined, discretely, at specific points or within specific regions by the particular combination of sensors A–D which are receiving light vs those which are not. For instance, in FIG. 3, two of the sensors C, D are occluded whereas the other two sensors A, B are not occluded. In FIG. 1, two of the sensors B, C are occluded while the other two sensors A, D are not occluded. In the Table which follows, within the column identified as FIGS. 1–3, the situation of FIG. 3 is expressed on line 3 of the Table, and the situation of FIG. 1 is expressed on line 5 of the Table. The Table indicates generally the occurrence of the elevator rising from a point where the vane is wholly outside of the optical unit 10 so that all four sensors A–D are receiving light and indicating a logical ONE, as expressed in line 1 of the Table. As the elevator continues to rise, eventually the optical unit will begin to overlap with the bottom of the vane so that the sensor A is occluded and now presents a logical ZERO, while the remaining sensors B–D continue to present logical ONEs as in line 2 of the Table. As the optical unit 10 continues to rise upwardly surrounding the vane 16, additional sensors B–C are occluded until, finally, A is no longer occluded and D is not yet occluded, but B and C are occluded as illustrated in FIG. 1 and line 5 of the Table. This is obviously the most central position, which is referred to herein as a dead zone (DZ). The other detectable zones of interest are identified as the outer zone (OZ) and the inner zone (IZ). Conversely, a descending elevator will yield the patterns of line 9 through line 1 of the Table, with symmetrically identical zones. Thus, FIGS. 1–3 and the portion of the Table relating thereto indicate how zones useful in elevators, frequently referred to as outer door zone, inner door zone and dead zone, are detectable discretely by the apparatus of the present invention.

Although not clearly shown in the scale of FIG. 1 or FIG. 3, the vane size, along the direction of relative movement, must be such as to allow the sensor A (FIG. 1) to become occluded while sensor C remains occluded, as the optical unit 10 is lowered from the dead zone (and similarly, D becomes occluded while C remains occluded when rising from the dead zone). Only in that way will the codes of the Table result, wherein there is only one transition from ONE to Zero at any position. This allows decoding 2 N states with N detectors.

Figure 4:
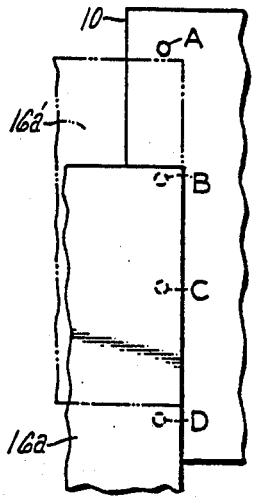
FIG. 4 is a partial side elevation view of a second embodiment of the present invention.
Figure 5:
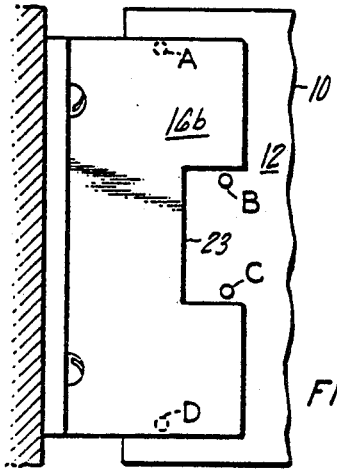
FIG. 5 is a partial side elevation view of a third embodiment of the invention, similar to the embodiment illustrated in FIG. 1.

| | FIG. 5 | FIG. 4 | FIGS. 1–3 | OZ | IZ | DZ | FAULT |
|---|---|---|---|---|---|---|---|
| 1 | 1 1 1 1 | 1 1 1 1 | 1 1 1 1 | 0 | 0 | 0 | 0 |
| 2 | 0 1 1 1 | 0 1 1 1 | 0 1 1 1 | 1 | 0 | 0 | 0 |
| 3 | 0 0 1 1 | 0 0 1 1 | 0 0 1 1 | 1 | 1 | 0 | 0 |
| 4 | 0 1 0 1 | 0 0 0 1 | 0 0 0 1 | 1 | 1 | 0 | 0 |
| 5 | 0 1 1 0 | 1 0 0 1 | 1 0 0 1 | 0 | 1 | 1 | 0 |
| 6 | 1 0 1 0 | 1 0 0 0 | 1 0 0 0 | 1 | 1 | 0 | 0 |
| 7 | 1 1 0 0 | 1 1 0 0 | 1 1 0 0 | 1 | 1 | 0 | 0 |
| 8 | 1 1 1 0 | 1 1 1 0 | 1 1 1 0 | 1 | 0 | 0 | 0 |
| 9 | 1 1 1 1 | 1 1 1 1 | 1 1 1 1 | 0 | 0 | 0 | 0 |
| 10 | 1 0 1 1 | | 1 0 1 1 | 0 | 0 | 0 | 1 |
| 11 | 1 1 0 1 | (Same | 1 1 0 1 | 0 | 0 | 0 | 1 |
| 12 | 0 0 0 1 | as | 0 1 0 1 | 0 | 0 | 0 | 1 |
| 13 | 1 0 0 1 | FIGS. | 0 1 1 0 | 0 | 0 | 0 | 1 |
| 14 | 1 0 0 0 | 1–3) | 1 0 1 0 | 0 | 0 | 0 | 1 |
| 15 | 0 0 1 0 | | 0 0 1 0 | 0 | 0 | 0 | 1 |
| 16 | 0 1 0 0 | | 0 1 0 0 | 0 | 0 | 0 | 1 |
| 17 | 0 0 0 0 | | 0 0 0 0 | 0 | 0 | 0 | 1 |

A feature of the invention which is illustrated in the portion of the table relating to FIGS. 1–3 is that failure modes can be detected. In this case, four sensors are utilized, and twice that number of zones are detectable as illustrated in lines 1–8 of the Table. In this particular case, lines 3 and 4 and lines 6 and 7 are decoded as being both outer and inner zones, and no distinction is made between them. However, that is simply because of the fact that a very large outer zone and a smaller inner zone are typically used in elevators. Obviously, these may be decoded with greater distinction if desired.

The faults, indicated in lines 10–17 of the Table, are specifically any code combination which is not a desirable zone decoded in lines 1–8 (and line 9 is the same as line 1). Thus, a combination of all binary ones is indicative of the fact that the optical unit 10 is not in the proximity of the vane 16; then there are seven specific, discretely-detectable zones as expressed in lines 2 through 8; any other code combination, including all zeros, is decodable as a fault.

This aspect of the invention, which results from the particular relationship between the vane and the sensors or other detectors, has several characteristics. First, there is no valid code with all of the lights off, and none is needed. This contrasts with the prior art where the dead zone is identified by all of the sensors being occluded. Since this is so, any case of total power failure, and cases of individual source or sensor failures can be detected. As an example, if sensor A failed, the condition of the elevator being between floors, which should be 1 1 1 1 (as in lines 1 and 9 of the Table) would in fact be decoded as 0 1 1 1 as in line 2 of the Table. Thus, there would be no way to tell whether there is a failure, or what position the elevator were in. However, once the elevator progressed through outer and inner and dead zones and into an upper inner zone as indicated in line 6, the impermissible code of all zeros (line 17) would show up and flag the fault. The fault would also show up since line 7 would in fact decode to the condition of line 16 and indicate a fault, and line 8 would decode to the fault indicated in line 13. Similarly, with any other single failure, one or the other of the desired zones would not be readable, but instead would result in an error code. It should be pointed out, however, that when the unit is standing still, if it is not standing on a code (such as line 7) in which the particular failure (such as sensor A) is a fault, then no fault can be detected. But in the course of traverse through all of the decodable positions, any fault will be detected.

Additional study of the codes illustrated with respect to FIGS. 1–3 in the Table shows that single fail-on situations and even multiple (one sensor on, one sensor off) situations can also be detected if very complex analysis of the entire encoded results are made. For instance, if all of the different codes (which occur during a given period of time in which the full range of relationship between the optical device 10 and the vane 16 can occur) are stored, precise knowledge of exactly what sort of failure has occurred can be gained, up to double order failures of the same type, and single order failures of different types (one on, one off). However, the invention may be used with much simpler fault encoding, as is described with respect to FIG. 6, hereinafter.

Referring now to FIG. 3, the particular position of the vane 16 with respect to the optical device 10 is the condition illustrated in line 3 with respect to FIGS. 1–3 in the Table. Reference to a dotted line 20 illustrates that the top of the vane 16 could be occluding three of the sensors B–D if the sensors B and C were positioned in a row along with the sensors A and D, as is illustrated in FIG. 4. Thus, the simplest embodiment of the present invention, illustrated in FIG. 4, need not have two rows of sensors and a stepped vane as has been described with respect to FIGS. 1–3 hereinbefore, but only a single row of them. In such a case, the encoding is exactly the same, as is illustrated in the lines 1 through 9 of the Table with respect to FIG. 4. However, for elevatoring purposes, the inner door zone would not commence (as shown in FIG. 3) by the occlusion of sensors C and D, but would commence (as shown in FIG. 4) by the occlusion of sensors B, C and D by the vane 16*a*. Thus the transition from outer zone to inner zone would occur between lines 3 and 4 with respect to FIG. 4 whereas it occurs between lines 2 and 3 with respect to FIGS. 1–3.

The difference between these two embodiments is that the embodiment of FIG. 4 can define the particular size of any zone only with respect to the other two zones. For instance, if the outer zone (only sensor A occluded as in line 2 or only sensor D occluded as in line 8) were to be lengthened, this could be achieved by simply spreading the distance between the detectors A and D. However, that would in turn lengthen the extent of the dead zone as is illustrated by the dotted lines 16*a*′ in FIG. 4. Other variations show similar interdependent relationships in the embodiment of FIG. 4 which become independent in the embodiment of FIGS. 1–3. This becomes apparent when it is condsidered in FIG. 4 that the inner zone occurs from the position shown in solid lines (sensors B–D occluded) throughout the extent of travel to the position shown in dotted lines (with only sensors B and C occluded). Thus, there are no transitions of the sensors B and C when near the inner zone. In contrast, reference to FIG. 1 shows that the inner zone is also controlled by the positioning of the sensors B and C, whereby flexibility in adjusting the zones, by means of position of the sensors and extent of the vane, can be made independently for outer, inner and dead zones (as well as other zones which are apparent in the encoding illustrated in the Table).

A variation of the embodiment of FIGS. 1–3 is illustrated in FIG. 5. Therein, the optical unit 10 has exactly the same configuration as that shown in FIG. 1, but the vane 16*b* is shaped to provide a dead zone with the sensors A and D occluded but with the sensors B and C not occluded, in a fashion which is complimentary to that of FIG. 1. This results in a slightly different code, as is illustrated in the Table with respect to FIG. 5, both for the permissible zones and for the error codes. The notch 23 in the vane 16*b* is in accordance with an invention disclosed and claimed in a commonly owned copending U.S. patent application filed on even date herewith by Shung, Ser. No. 093,474, entitled TAILORABLE DISCRETE OPTICAL SENSOR. It should be apparent from comparison of FIGS. 1, 4 and 5 that the invention may be practiced with a variety of configurations, as well as a variety of detecting elements. Similarly, four detectors are shown in all of the embodiments herein, resulting in eight detectable permissible conditions and eight failure modes. In the same fashion, depending upon the particular utilization to which the present invention is to be put, various numbers of detectors may be utilized. For instance, if five detectors are used, then ten valid states are detectable and ten error codes are detectable. The invention is unconcerned with the number of detectors which are used, or with any specific shaping of a vane or the equivalent which will cause an encoding of the occluded detectors vs non-occluded detectors, and which therefore distinguish valid discrete positions and also permit the detecting of errors. What the invention is concerned with is that there be no valid condition when all of the detectors can be occluded (or providing a binary zero state), and that there be a dead zone or centrally, mutually-aligned condition (as illustrated in FIGS. 1 and 5) where the state of the outer two detectors differ from the state of at least one other detector. And, although the embodiments of FIGS. 1–3 and FIG. 5 show two rows of detectors, if more zones are required and they are to be variably separated from each other, even more rows could be used, without departing from this invention.

Figure 6:
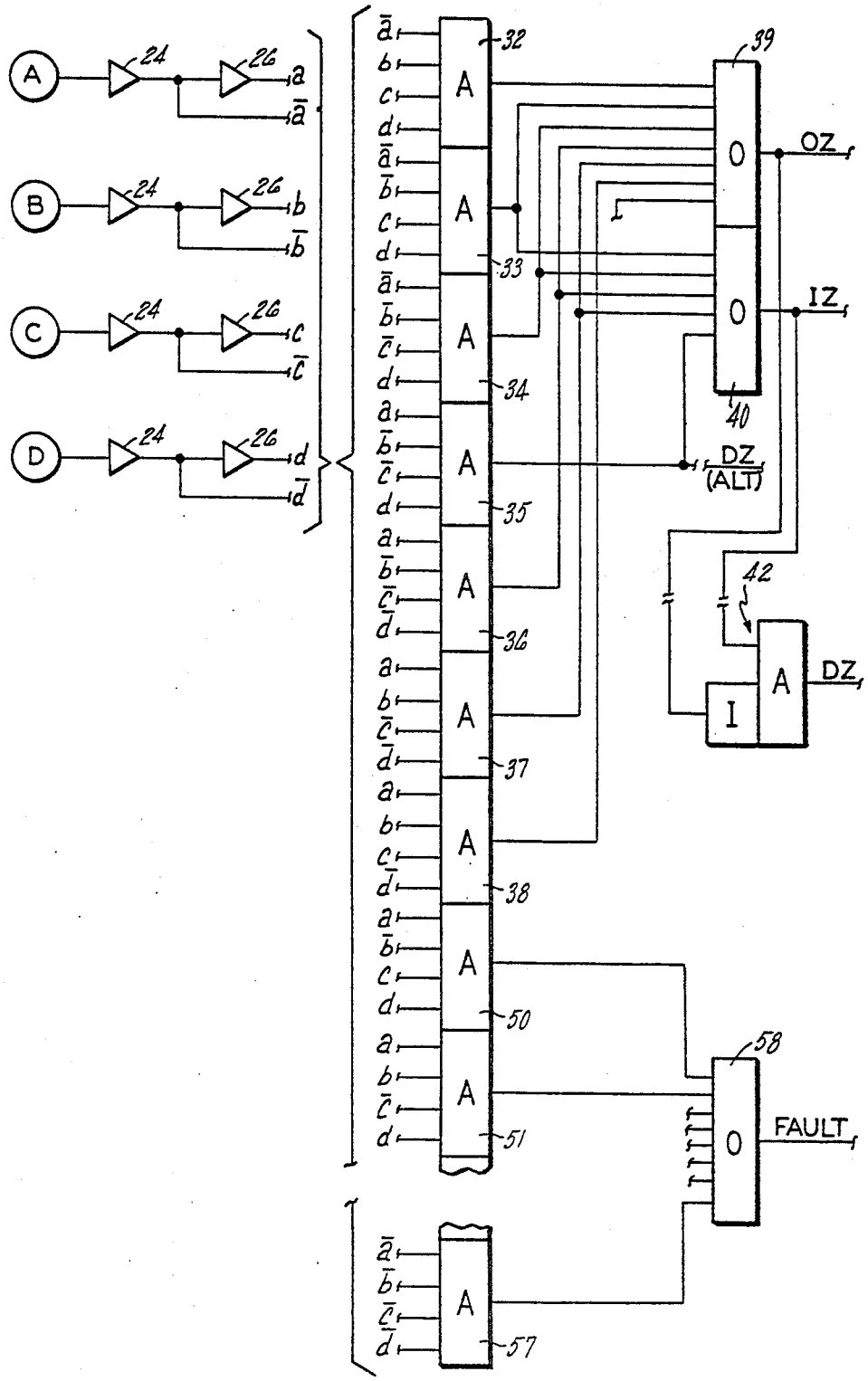
FIG. 6 is a simplified schematic block diagram of exemplary decoding circuitry useful in conjunction with the various embodiments of the invention.

An exemplary decode circuit, to implement the decoding of the permissible states and the fault states illustrated in the Table with respect to FIGS. 1–3, is shown in FIG. 6. Therein, each of the sensors A, B, C, D is connected through a corresponding amplifier 24 to provide a suitable signal, being an inversion of the operative state of the sensor to provide related signals a, b, c and d; these are, in turn, passed through additional related amplifiers 26 for each sensor to provide corresponding signals $\bar{a}$, $\bar{b}$, $\bar{c}$, $\bar{d}$ representative of the operation (or the binary one state) of the corresponding detector. Decoding of these states in a plurality of AND circuits 32–38, which correspond to lines 2 through 8 of that portion of the Table referring to FIGS. 1–3, and collecting their outputs in OR circuits 39, 40 provide the outer zone (OZ) and inner zone (IZ) signals. As shown, the dead zone (line 5 of the Table) is determinable remotely of the decode circuit of FIG. 6 by sensing the condition of there being an inner zone signal concurrently with no outer zone signal, which may be achieved with circuitry 42 of FIG. 6. This reduces the amount of wiring or signal handling required in order to detect all three permissible zones in the elevator example described herein. On the other hand, if desired, the AND circuit 35 could have its output utilized as an indicator of dead zone, and the outer zone OR circuit 39 could be connected to the AND circuit 35. In such case, three wires or outputs would be required in order to detect all three zones; in such case, circuitry 42 or equivalent decoding would not be used.

The decoding of faults is illustrated in the bottom of FIG. 6 to include a plurality of AND circuits 50–57 (some of which are not shown for simplicity) each of which corresponds to one of the lines 10–17 of the Table, which feed an OR circuit 58 to generate the fault signal. As described hereinbefore, whenever a fault occurs, if indications of which of the AND circuits 50–57 have caused the fault to occur are retained (since none of these conditions exist coextensively with another) any single error fault can be detected. And, by combining information as to which of the AND circuit 50–57 have operated to indicate a fault, and which of the AND circuits 32–38 have or have not operated during a complete passage of the optical unit 10 across the vane 16, even power on and double sensor failures can be analyzed. However, the use to which the information provided by the present encoder is put is not a limiting factor on the invention, and may be as simple or as complex as is desired in any embodiment in which the invention is used.

The detectors and vanes described herein are symmetrical along the direction of motion, but they need not be if symmetrical inner, outer and other zones are not desired on either side of central, mutual alignment of the members. And, whether symmetrical or not, they need not be equally spaced, as is apparent from the figures herein. For use in elevator zones, in which equal inner and outer zones occur both above and below the dead zone, symmetry is preferable.

Similarly, although the invention has been shown and described with respect to exemplary embodiments thereof, it should be understood by those skilled in the art that the foregoing and various other changes, omissions and additions may be made therein and thereto without departing from the spirit and the scope of the invention.

I claim:

1. A position encoder comprising a first member and at least one second member, said members being relatively movable with respect to each other, said first member having disposed thereon N detectors, each having two states, the proximity of said second member with each of said detectors causing such detector to assume a first one of two states and the absence of said second member in proximity with any detector causing such detector to assume the other one of said states, said plurality of detectors being disposed on said first member in sequence along a direction of relative motion between said first member and any of said second members, said detectors being spaced apart from one another, said second member being sized and shaped to provide a length of effectiveness with respect to each of said detectors, along said direction of relative motion, to provide transition from one of said states to the other of only one of said detectors at one time, thereby to provide a pattern of the one of said states in which the various one of said detectors are in having two-N discrete positional zones which are symmetrical with respect to central alignment of said two members with one another, and to provide, when said first member and said second member are in maximum, central alignment along said direction of motion, the two outermost ones of said detectors in one of said states with at least one other of said detectors in another, different one of said states.

2. A position encoder according to claim 1 wherein said detectors are aligned in a single row.

3. A position encoder according to claim 1 wherein said states are further capable of decoding two-N failure conditions.

4. A position encoder according to claim 1 wherein said detectors are arranged in two parallel rows, said rows being parallel to the direction of relative motion of said two members, said two outer detectors being in a first row with each other.

5. The encoder according to claim 4 wherein a second row of said detectors has at least two detectors therein and said second member is shaped so that said two detectors therein are in a state that is opposite to the state of said two outer detectors when said two members are in mutual alignment, whereby the positional extent of the relative positional zones of said encoder are symmetrically, independently adjustable.

* * * * *